United States Patent [19]

Morane et al.

[11] 3,987,942

[45] Oct. 26, 1976

[54] DISPENSING CAP FOR USE WITH AEROSOL CONTAINERS AND HAVING A SEPARABLE ACTUATING HANDLE

[75] Inventors: Bruno Morane, Paris; Daniel Goyet, Romainville, both of France

[73] Assignee: Societe Anonyme dite: L'Oreal, Paris, France

[22] Filed: May 27, 1975

[21] Appl. No.: 580,970

[30] Foreign Application Priority Data

June 26, 1974 France ..... 74.22214

[52] U.S. Cl. ..... 222/402.15

[51] Int. Cl.[2] ..... B65D 83/14

[58] Field of Search..... 222/182, 402.15, 402.21, 222/402.22, 402.23, 402.13

[56] References Cited

UNITED STATES PATENTS

| | | | |
|---|---|---|---|
| 3,189,232 | 6/1965 | Joffe | 222/402.15 X |
| 3,698,604 | 10/1972 | Nigro | 222/402.13 X |

*Primary Examiner*—Stanley H. Tollberg
*Attorney, Agent, or Firm*—Brisebois & Kruger

[57] ABSTRACT

Dispensing cap for pressurized containers comprises a wall adapted to snap onto the top of the container, a movable member defining a duct adapted to seat on the outlet tube of the container valve and through which its contents may be ejected, and a separable actuating member which projects through the wall to actuate the movable member.

18 Claims, 12 Drawing Figures

DISPENSING CAP FOR USE WITH AEROSOL CONTAINERS AND HAVING A SEPARABLE ACTUATING HANDLE

SUMMARY OF THE INVENTION

Conventional pressurized container of the aerosol bomb type comprise a chamber holding the product to be dispensed and a pressurizing fluid, and are equipped with a dispensing valve operated by the user when he desires to dispense the product stored in the chamber. The dispensing valve may be actuated by means of a push button but, in order to improve the attractiveness of the container, a dispensing cap is usually associated therewith. This cap is positioned beyond one end of the chamber within the locus defined by the cylindrical periphery of the chamber and comprises a movable part adapted to control the valve outlet, as well as a duct which fits onto the outlet tube of the valve and leads the product to be dispensed to the lateral external wall of the cap.

It is well known that one of the disadvantges of the pressurized containers of this type is that they may be actuated by children by simply pressing on the movable part of the cap and this leads to a substantial risk, to the extent to which the product stored in the container is corrosive as is true, for example, in the case of certain cleaning products.

It is the object of the present invention to provide a dispensing cap which may be associated with a pressurized container of the aerosol bomb type which makes it possible to avoid the above mentioned danger by removing the movable member which operates the valve outlet when the container is stored and/or is not being used to dispense the product. According to the invention, the dispensing cap is accordingly provided with a removable actuating handle which may be stored by the user of the container in some place other than the place in which the container is stored. Another advantage of the cap according to the invention is to permit the successive actuation of several aerosol bombs equipped with such caps with a single removable handle, thus decreasing the cost of a group of pressurized containers. In accordance with the invention the removable actuating handle may comprise a member substantially parallel to the external wall of the container, which member serves as a trigger and increases the facility with which the pressurized container according to the invention may be operated as compared with comparable device already on the market.

It is therefore an object of the present invention to provide as a new article of manufacture a dispensing cap adapted to be associated with a pressurzied container of the aerosol bomb type, which container comprises a dispensing valve, said cap being associated with a movable top adapted to fit onto the outlet of the valve, an actuating member capable of being operated from outside the cap and cooperating with a movable duct to cause a movement of said duct which is capable of opening the dispensing valve. The invention is characterized by the fact that the outer wall of the cap comprises at least one orifice through which a part of a removable actuating member may be introduced, so that said actuating member, after introduction into the cap, bears on the movable duct or on a member fixed thereto.

In a preferred embodiment, a cap according to the invention is substantially cylindrical in shape and comprises at least one orifice in its lateral wall. The actuating member is introduced radially into the cap and comprises a fork, the two teeth of which pass on opposite sides of the movable duct of the cap. The teeth of the fork of the actuating member bear on at least one abutment provided on the lateral external surface of the axial portion of the movable duct. The abutments may be formed by an annular shoulder or by diametrically opposed projections. The actuating member has two arms at right angles to each other, with one arm carrying the fork which bears on the movable duct and the other arm constituting a handle which is operable from outside the cap. The cap has at least one internal abutment diametrically opposite to the orifices formed in its wall. This abutment or abutments constitute a fulcrum for the end of the actuating member which is inserted into the cap. The cap also has internal guides on opposite sides of the movable dispensing duct, these guides being substantially parallel to the direction of insertion of the actuating member and positioned on opposite sides of the orifice or orifices formed in the external wall of the cap. The cap is attached to the container with which it cooperates by means of an annular ridge, which may be continuous or discontinuous, and is located on the inner part of the lateral wall of the cap, said ridge being adapted to snap into a groove on the lateral surface of the pressurized container. This groove may be provided by either appropriately forming the wall of the pressurized container or mounting on this container an intermediate member defining said groove.

In a first embodiment of the invention the movable duct of the cap is fixed to the lateral wall of the cap, opens outside the cap, and has a section which is elastically deformable by the actuating member. The cap is then made in two parts. One of the parts of the cap comprises the lateral wall of the cap, the said movable duct having one arm which is positioned axially of said lateral wall and another arm which is elastically deformable, and parallel guides for the elastically deformable arm of the movable duct, and an internal abutment positioned in alignment with the zone between the two guides. The other part of the cap consists of the top of the cap which is fastened to the first part.

In a second embodiment of the cap according to the invention, the movable duct of the cap is a separate part which is assembled with said cap and opens outside said cap, the remainder of the cap being made in one piece. The movable duct has two arms at right angles to each other, the first arm being positioned substantially axially of the cap and cooperating at its base with the outlet tube of the dispensing valve, while the second arm is substantially radial and carries at its end a sliding guide plate which engages in grooves provided for this purpose inside the cap, parallel to the radial arm of the movable dispensing duct, and on opposite sides thereof. The cap comprises, on the one hand, two strips serving as guides for the actuating member and, on the other hand, two projections located between the strips and forming abutments for the two teeth of the actuating member.

In a third embodiment of a cap according to the invention the member through which the pressurized fluid flows forms part of the actuating member of the cap according to the invention. This arrangement has the advantage of permitting easy cleaning of the dispensing nozzle by simple washing of the removable handle, which may be especially desirable when the fluid being dispensed is capable of blocking the dispensing nozzle, when dry. It is also possible, since the removable handle comprises the dispensing nozzle, to clean the dispensing duct inside the removable handle by associating said handle with a pressurized container containing a cleaning solvent.

The cap according to the third embodiment of the invention comprises an actuating member in the form of a fork which is characterized by the fact that its movable duct is a separate part comprising a passageway having two sections at a right angle to each other, one of which is substantially parallel to the axis of the cap, and the other of which is substantially radial and terminates in a first mouth. The fork of the actuating member has at the bottom of the groove separating its two teeth, a second mouth which may cooperate with the first mouth and said second mouth comprises one of the ends of a passage formed inside the actuating member, the other end of which passage opens outside the actuating member and outside the cap when said actuating member is located in the cap. The mouths are mating male and female conical mouths. The first mouth is a male mouth and the second a female mouth. The upper part of the movable duct has, perpendicularly to the axis of the duct which fits onto the dispensing valve of the container, a section having two elongated flats which cooperate, during the relative positioning of the movable duct with respect to the external wall of the cap, with members fixed to said external wall. The members fixed to the external wall of the cap which permit the relative positioning of the movable duct with respect to said external wall are guides positioned on opposite sides on the orifice formed in the outer wall for the passage of the actuating member. These guides are adapted to guide the actuating member during its introduction into the cap and lie at a slight angle to each other, the two elongated flats of the section of the upper part of the movable duct forming between them an angle substantially equal to the angle between the guides.

It is obvious that the cap according to the invention may advantageously be molded from a plastic material. In the case of the first of the above described embodiments the cap comprises three members, to wit: the lateral wall of the cap and the members which are connected thereto, the top of the cap which is fastened thereto, and the removable actuating member. In the case of the second of the above described embodiments the cap according to the invention is made of three different parts, to wit: the cap proper, the movable dispensing duct which fits therein, and the movable actuating member which is associated with the cap. In the case of the third of the three embodiments described above, the cap according to the invention is made of three parts as in the case of the second embodiment, with the movable duct having in fact no direct connection with the outer wall of the cap.

It will be seen that the mounting of the cap according to the invention on the top of a pressurized container of the aersol bomb type does not permit the actuation of the container and the dispensing of the products therein unless the user has a suitable actuating member. The manufacturer may furthermore, supply a group of aerosol bombs, each equipped with a cap, but only one actuating member for the group.

It is a further object of the present invention to provide as a new article of manufacture a pressurized container of the aerosol bomb type characterized by the fact that it is associated with a dispensing cap of the type hereinbefore described.

In order that the invention may be better understood three representative embodiments thereof will now be described, purely by way of illustration and example, with reference to the accompanying drawings on which:

Figure 1:
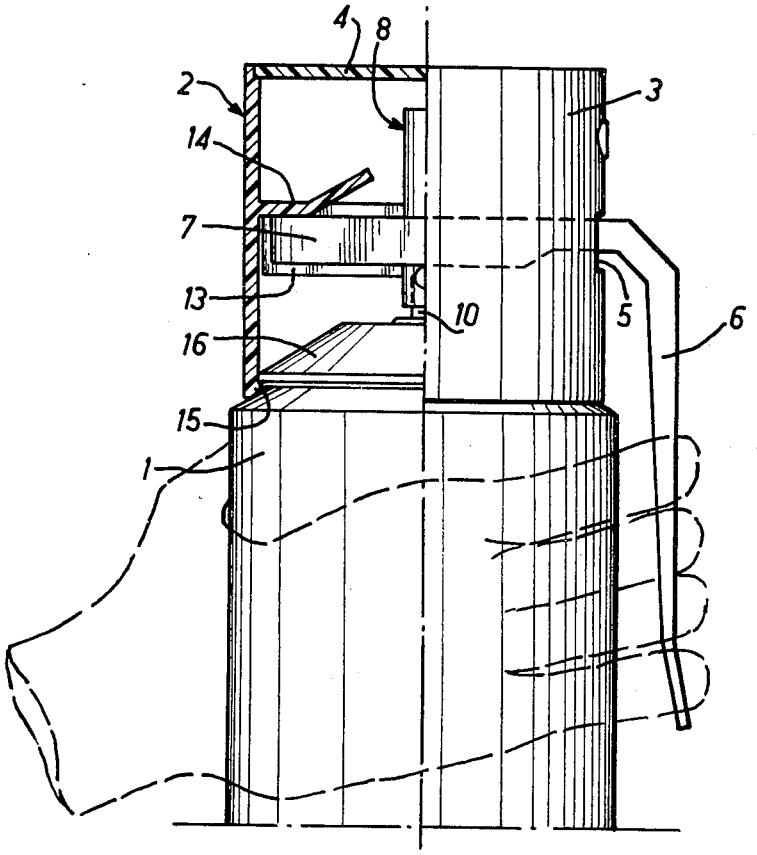
FIG. 1 shows, partially in section and partially in elevation, a schematic view of the top of a pressurized container of the aerosol bomb type, equipped with a cap according to the first embodiment of the invention.
Figure 2:
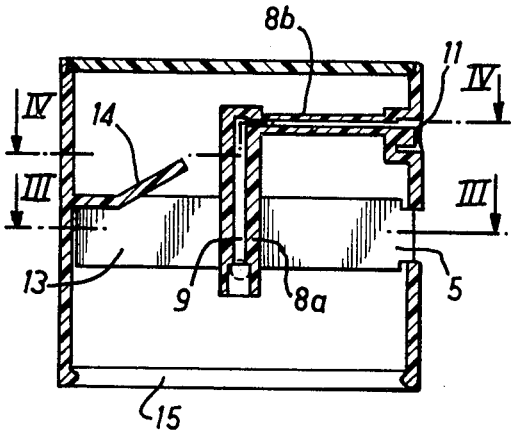
FIG. 2 is an axial sectional view taken through the cap of FIG. 1, with the actuating member removed and the section taken through the axis of the movable dispensing duct.
Figure 3:
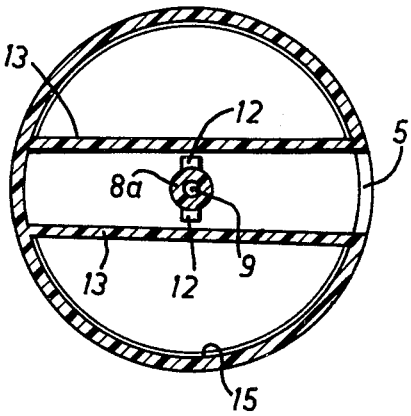
FIG. 3 is a sectional view taken along the line III—III of FIG. 2.
Figure 4:
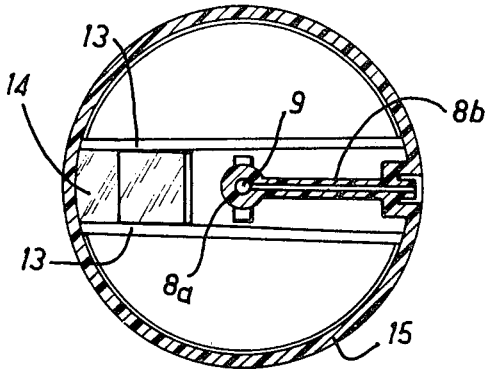
FIG. 4 is a sectional view taken along the line IV—IV of FIG. 2.

Referring now to the drawings, and more particularly to FIGS. 1 to 5, it will be seen that reference numeral 1 indicates the container of the aerosol bomb type which carries the cap 2 according to the invention. The cap 2 is made of a molded plastic material. It comprises a cylindrical lateral wall 3 and a top in the form of a disc 4. The top 4 is seated in or sealed to the upper part of the cylindrical wall 3. The lateral cylindrical wall 3 has, substantially half way up, an approximately rectangular opening 5 which receives an actuating member 6 which has two arms at right angles to each other. One of the arms of the actuating member 6 comprises a fork 7, two teeth 7*a*, 7*b*, of which are positioned on opposite sides of the axial part 8*a* of a movable dispensing duct 8. The duct 8 consists of two tubes at right angles to each other. One of these tubes, 8*a*, is positioned substantially along the axis of the lateral wall 3 and the other, 8*b*, is positioned radially between the part 8*a* and the lateral cylindircal wall 3. The movable duct 8 is molded in one piece with the lateral wall 3. Inside the parts 8*a*, 8*b* of the movable duct 8 are axial passageways 9 which connect the base of the part 8*a* and the end of the part 8*b* which opens outside the cap. The base of the part 8*a* of the duct 8 fits onto the end of the outlet tube of the valve 10. The zone 11 of the lateral wall 3 through which the duct 9 opens may be equipped with a spray nozzle (not shown). Near its base, the part 8a of the movable duct 8 carries two external projections 12 which are diametrically opposite each other.

At the level of the orifice 5 formed in the lateral wall 3 guide strips 13 are provided on opposite sides of the part 8*a* of the duct 8. The strips 13 are parallel to the axis of the cap and, when seen in plan, their lines constitute symmetrical chords with respect to the diameter passing through the central part of the orifice 5. Between the two strips 13 opposite the orifice 5 is an abutment 14 comprising a first portion connected to the lateral wall 3 which is a perpendicular to the axis of the cap and a second portion nearer the axis which is upwardly inclined. At the base of the lateral wall 3 on the inner wall of the cap is a thin peripheral ridge 15 which cooperates with a groove formed on the aerosol bomb 1 by an intermediate member 16 which is fitted in a conventional manner onto the first frusto-conical upper part of the aerosol bomb 1.

The aerosol bomb 1 is sold equipped with its dispensing cap without the actuating member 6–7 being placed inside the cap. The cap 2 is attached to the bomb 1 due to the cooperation between the ridge 15 and the intermediate member 16 which is fixed to the bomb 1. Once the cap has been mounted the outlet tube of the valve 10 is in contact with the base of the part 8*a* of the movable duct 8. When it is desired to dispense the contents of the container the fork 7 of the actuating member is inserted through the orifice 5 until the ends of the teeth 7*a*, 7*b* are positioned above the horizontal part of the abutment 14. During this insertion the actuating member is guided laterally by the strips 13 and comes into position above the projections 12. The user takes the aerosol bomb which has been equipped in this manner in his hands so that his fingers rest on the part 6 of the actuating member, which acts as a trigger outside the aerosol bomb. When the fingers of the user press on the handle 6 bringing it toward the aerosol bomb, the actuating member acts as a lever, the fulcrum of which is situated at the ends of the teeth 7*a* and 7*b* of the fork 7. This lowers the projections 12, as is permitted by the elasticity of the part 8*b* of the movable duct 8. In the course of this movement the outlet tube of the valve 10 is depressed sufficiently to dispense the product stored therein, which is ejected from container 1 through the tube 10, duct 9 and the zone 11.

It will be seen that, if the actuating member 6–7 is not inserted into the cap 2, it is impossible for the user to dispense the contents of the bomb.

Referring now to FIGS. 6 to 9 it will be seen that reference numeral 21 indicated a pressurized container of the aerosol bomb type having a frusto-conical upper part, a groove being preformed in the wall of the aerosol bomb 21 at the level at which the frusto-conical part is connected to the cylindrical prat of its outer wall. This groove has been indicated by reference numeral 22 on the drawing. The container 21 is associated with a dispensing cap 23. The cap 23 has a generally cylindrical shape and comprises on the inner surface of the lower end of its peripheral wall a ridge 24 which cooperates with the groove 22 to attach the cap 23 to the container 21. The container 21 has a dispensing valve, the outlet tube 25 of which cooperates with the movable dispensing duct 26, the duct 26 being a member which may be assembled with the cap 23 proper, but is molded separately. The duct 26 has a part 26a positioned along the axis of the cap 23 and a part 26b perpendicular thereto and positioned radially with respect to the cap. The two parts 26*a* and 26*b* are thus at right angles to each other. At the lower end of the part 26*a* is a collar 27 the outer diameter of which is greater than the outer diameter of the part 26*a*. The collar 27 constitutes the base of the part 26*a* and fits on the end of the outlet tube of the valve 25. At the end of the part 26*b* which is not connected to the part 26*a* is a sliding plate 28 adapted to insure the assembly of movable duct 26 with the cap 23 proper. Along the axis of the parts 26*a* and 26*a* is a passageway 29 which connects the base of the collar 27 and the end of the part 26*b* which carries the sliding plate 28.

Cap 23 comprises a cylindrical lateral wall 23*a* and an upper surface 23*b*. The upper surface 23*b* comprises a central orifice 30 which is used to test the pressurized containers ready for sale. Inside the cap 23 are two guide strips 31 and two abutment members 32, all four of which are attached at their upper part to the upper surface 23*b* of the cap 23 and at their lateral edges to the lateral wall 23*a* of the cap 23. In the lateral wall 23*a* a rectangular window 33 is formed, on opposite sides of which are grooves 35 defined by ribs 34 carried by the fins 32. The two grooves 35 are parallel to the axis of the cap and are open at their lower ends. The separation of these two grooves is such that the edges of the sliding plate 28 may be seated therein. This plate may also be assembled with the cap proper.

The orifice of the duct 29 is slid into alignment with the median zone of the window 33. The strips 32 are substantially parallel and symmetrical with respect to the axial median plane of the window 33. The guide strips 31 are also symmetrical with respect to this same plane but are slightly divergent in the direction of the window 33. The lower edge of the strips 31 is parallel to the upper face 23*b* of the cap. The lower edge of the strips 32 is, on the one hand, parallel to the upper face 23*b* of the cap in the zone remote from the window 33 and, on the other hand, slightly inclined upwardly over the rest of its length.

Figure 6:
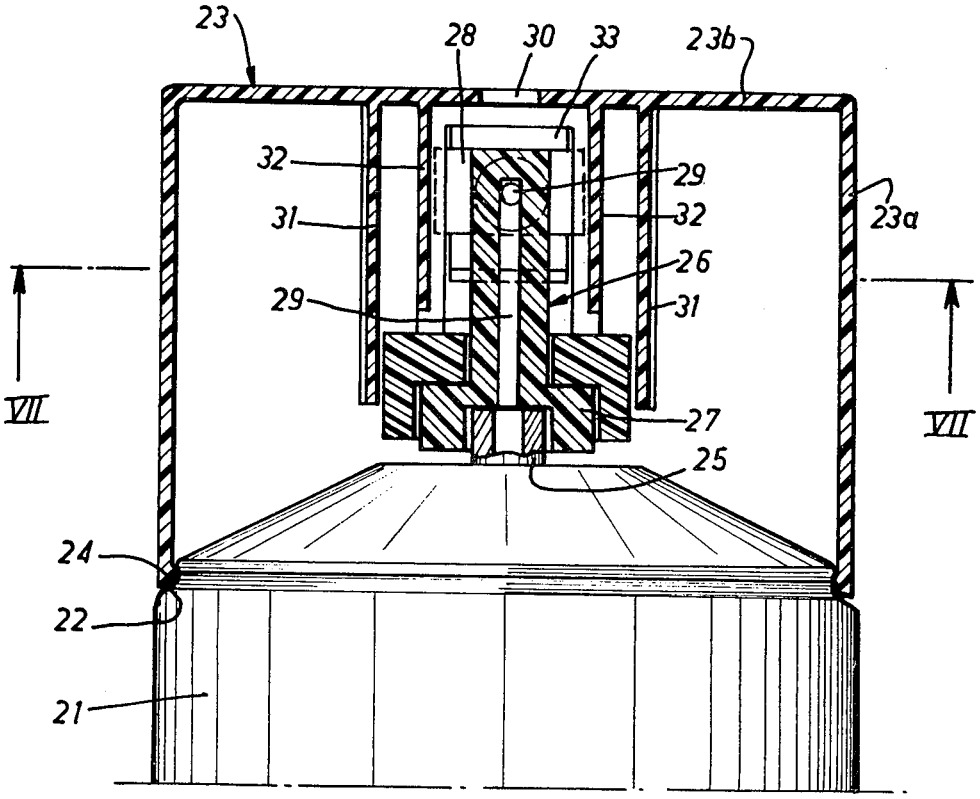
FIG. 6 is an axial sectional view taken through a cap according to the second embodiment of the invention mounted on top of an aerosol bomb, said cap being equipped with its actuating member and the section being taken in a plane perpendicular to the radial arm of the movable dispensing duct.
Figure 5:
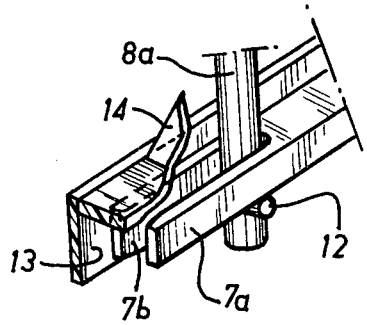
FIG. 5 is a perspective view showing in detail the relationship between the actuating member and the movable dispensing duct in the device of FIG. 1.
Figure 9:
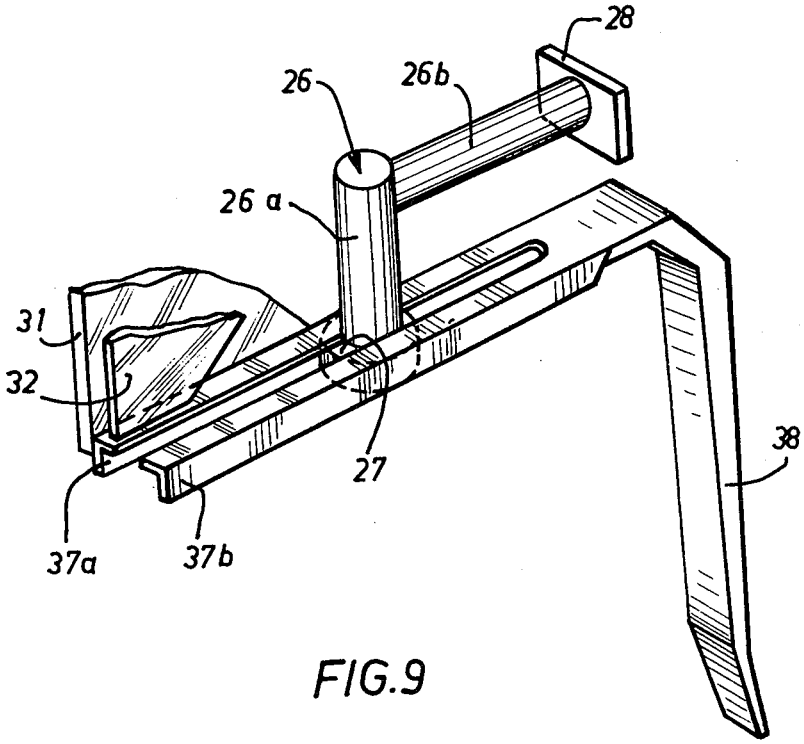
FIG. 9 is a perspective view showing in detail how the actuating member cooperates with the movable duct of the cap of FIG. 6.
Figure 7:
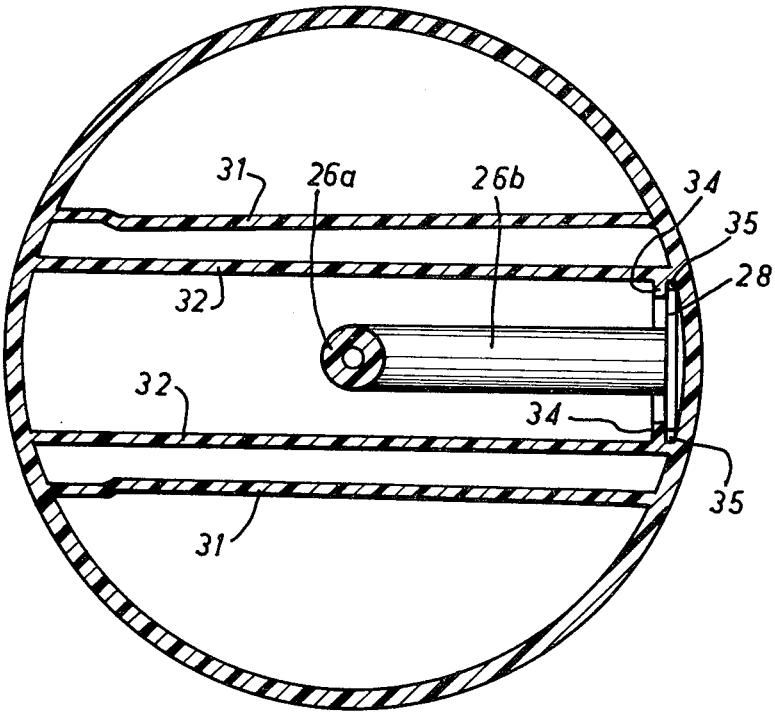
FIG. 7 is a sectional view taken along the line VII—VII of FIG. 6.
Figure 8:
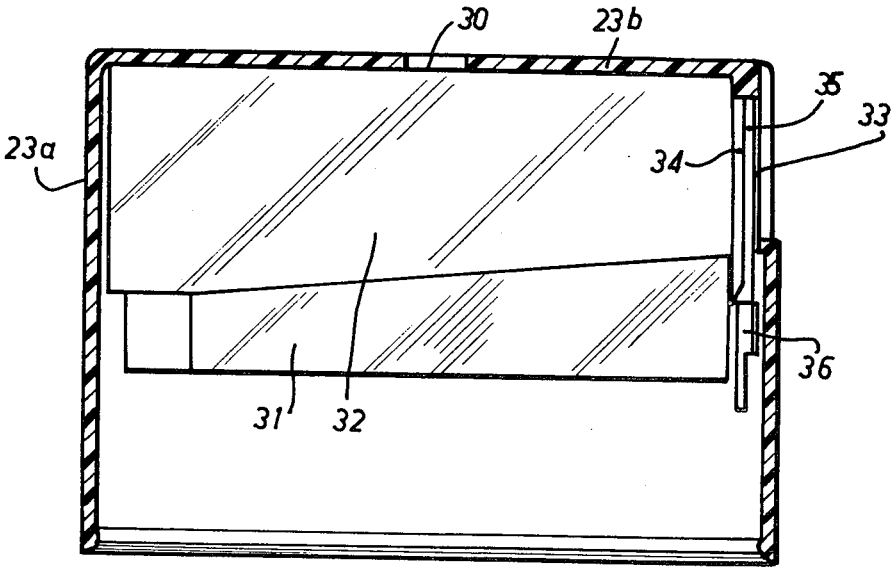
FIG. 8 is an axial sectional view taken through the cap of FIG. 6 in a plane perpendicular to the plane of FIG. 6, with both the movable dispensing duct and the actuating member removed.

The lateral wall 23*a* of the cap 23 also has beneath the window 33 in the space defined by the two strips 31, two openings 36 which are angular in shape, the two openings 36 being symmetrical with respect to the axial median plane of the window 33. The two openings 36 are adapted to receive the two teeth 37*a*, 37*b* of a part 37 which constitutes one of the arms of the actuating member, the other arm of which is a handle 38. Each of the teeth 37*a*, 37*b* has a right angle profile, the section of which corresponds to the section of the orifices 36. When the cap 23 is mounted on the aerosol bomb 21 by snapping the ridge 24 into the groove 22, the collar 27 bears on the outlet tube of the valve 25, as is illustrated in FIG. 6. When the teeth 37*a*, 37*b* of the actuating member are introduced into the corresponding orifices 36 until these teeth bear at their ends against the opposite internal wall of the cap 23, the corners which are constituted by the teeth 37*a*, 37*b* come to bear by their lateral flanges against the upper part of the collar 27, with their vertical flanges lying on opposite sides of said collar. The horizontal flanges of the teeth 37*a*, 37*b* are positioned at their ends beneath the horizontal parts of the lower edges of the abutment 32 while the vertical flanges of the two teeth 37*a*, 37*b* are guided during insertion of the fork 37 into the cap 23 by the guide strips 31. The handle 38 is then positioned parallel to the body of the aerosol container 21.

When the user takes the aerosol container in his hand, the handle 38 constitutes the trigger on which his fingers may press. If such pressure is applied, the actuating member 37, 38 acts as a lever, the fulcrum of which is in the zone at which the teeth 37*a*, 37*b* bear on the horizontal parts of the lower edges of the abutment 32. In this movement the collar 27 is displaced downwardly so as to cause an analogous movement of the outlet tube of the valve 25 and consequently permit the dispensing of the product stored in the container through the tube 25 and the passage 29, said product being ejected through the window 33. The movement of the movable duct 26 takes place due to sliding of the plate 28 inside the groove 35 in response to the action of the lever or by elastic deformation of the part 26b of the duct 26 or a combination of the two.

It is clear that the advantages of this second embodiment are substantially the same as those of the first embodiment since the aerosol bomb cannot be operated without using the removable actuating member 37–38. The two embodiments which have been thus far described correspond to two different methods of molding but, in both cases, the cap equipped with its actuating member consists of three separately molded parts.

Figure 10:
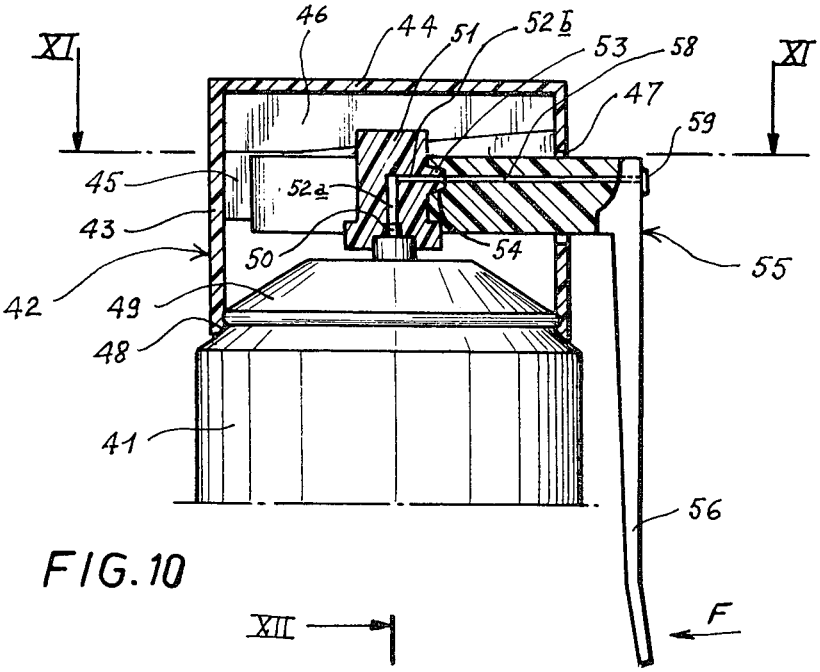
FIG. 10 is an axial sectional view taken through a cap according to the third embodiment of the invention.
Figure 11:
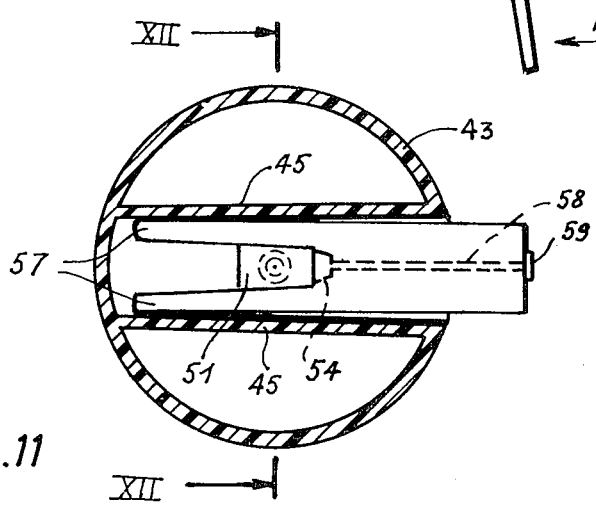
FIG. 11 is a sectional view taken along the line XI—XI of FIG. 10.
Figure 12:
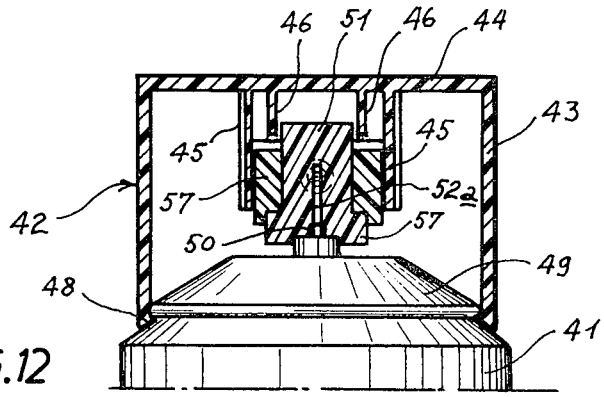
FIG. 12 is a sectional view taken through the cap of FIG. 10 along the line XII—XII of FIG. 11.

Referring now to FIGS. 10 to 12, it will be seen that reference numeral 41 indicates a pressurized container of the aerosol bomb type on the upper part of which a cap 42 according to the invention has been mounted. The cap 42 is made of a molded plastic material and comprises a lateral cylindrical wall 43 and a top 44 molded integrally with the lateral wall 43. Internally the cap 42 comprises two guide strips 45 and two abutment strips 46, all four of which are secured at their upper ends to the upper surface of the cap 42 and, at their lateral edges, to the lateral wall 43 of the cap 42. In the lateral wall 43 a rectangular window 47 is formed. This positioned between the guide strips 45. The guide strips 45 are slightly divergent in the direction of the window 47. The abutment strips are substantially parallel and both lie between the guide strips 45. The height of the guide strips 45 is substantially constant whereas the height of the abutment strips 46 increases from the area near the window 47 up to a certain distance from the diametrically opposite zone, said height nevertheless remaining always less than that of the guide strips 45. The lower part of the lateral wall 43 of the cap 42 carries a peripheral ridge 48 which cooperates with a neck formed on the aerosol bomb 41 by an intermediate member 49 which is fitted in a known manner onto the upper frusto-conical part of the aerosol bomb 41.

A member 51 has been fitted on the outlet tube of the valve 50 and serves as a movable duct having an internal passage, the first part 52*a* of which is in alignment with the outlet tube of the valve 50, and the second part 52*b* of which is perpendicular to the part 52*a*. The passage 52*b* opens at the outside of the movable duct 51 through a conical male mouth 53 adapted to cooperate with a conical female mouth 54 formed in an actuating member indicated by reference numeral 55. The actuating member 55 is a handle having two parts at right angles to each other. One of these parts 56, is adapted to be manipulated by the user outside the cap 42 and the other part perpendicular to the first, is adapted to be introduced into the space defined inside the lateral wall 43 through the window 47 in that lateral wall. This part of the actuating member 55 consists of a fork, the two teeth 57 of which are located on opposite sides of the movable duct 51. The movable duct 51 has, in a plane perpendicular to the axis of the duct 52*a*, a trapezoidal section, the angle between the two non-parallel sides of the two trapezoid being slight and substantially equal to the angle between the sides of the teeth 57 which come in contact with the movable duct 51. In this manner the actuating member 45 may be guided as it is introduced through the window 47, so that the movable duct 51 has its conical mouth 53 directed toward the window 47 and not in the opposite direction. The insertion of the actuating member 55 can take place only if the mouth 53 is properly located with respect to the window 47.

When the actuating member 55 is located in position as indicated on FIG. 10, the upper part of the ends of the teeth 57 is in alignment with the part of the abutment strips 46 which is furthest from the window 47. The guide strips 45 have served to guide the fork of the actuating member during the course of its insertion through the window 47. When this insertion has been completed, conical male mouth 53 is inserted in the conical female mouth 54 which has been provided at the bottom of the fork defined by the two teeth 57. The conical female mouth 54 is connected to a passageway 58 formed in the part of the actuating member 55 in alignment with the fork formed by the two teeth 57. The passageway 58 opens to the outside through a spray nozzle 59 positioned in a zone in which the actuating member is bent at a right angle.

When the user presses on the handle 56 in the direction of the arrow *f*, the upper part of its teeth 57 come to bear against the abutment strips 46, thus permitting the depression of the movable duct 51 and the opening of the valve of the container 41. The pressurized product is ejected through the movable duct 51, through the passageways 52*a*, 52*b*, and then passes through the passageway 58 to reach the spray nozzle 59 which permits its ejection to the exterior of the cap.

The particular advantage of this third embodiment, which is made in three distinct parts, is to provide the spray nozzle 59 on the actuating member 55, so that if only a single actuating member is supplied for a group of pressurized containers, an additional economy results, since each container is equipped only with a cap 42 and a movable duct 41 without any spray nozzle. It will, of course, be appreciated that the embodiments hereinbefore described have been given purely by way of illustration and example and may be modified as to detail without thereby departing from the basic principles of the invention.

What is claimed is:

1. In a dispensing cap adapted to be associated with a pressurized container which container comprises a dispensing valve, said cap comprising movable means defining a duct adapted to fit on the outlet of the val , a lateral external wall defining at least one orifice, and a separate, removable actuating member adapted to be inserted through said orifice into said cap and cooperate with the movable duct to produce a movement thereof capable of causing the dispensing valve to be opened, when said actuating member is operated, the improvement according to which the actuating member, after introduction into the cap, comes to bear against said movable means and said cap comprises internal guide means positioned on opposite sides of said movable means to guide said actuating member as it is inserted into said cap, said guide means extending in the same general direction as that in which the actuating member is inserted and being positioned on opposite sides of said orifice in the external wall of the cap.

2. Cap as claimed in claim 1 having a substantially cylindrical shape in which said actuating member extends substantially radially into said cap.

3. Cap as claimed in claim 1 in which the actuating member comprises a forked end, the two teeth of which pass on opposite sides of the movable duct of the cap.

4. Cap as claimed in claim 3 in which the teeth of the actuating member bear on at least one projection on the lateral external surface of an axial segment of said movable means.

5. Cap as claimed in claim 4 in which the projection on the lateral surface of the movable means consists of an annular shoulder.

6. Cap as claimed in claim 3 in which the actuating member has two arms at right angles to each other, one arm of which comprises a fork and the other arm of which constitutes a handle positioned to be actuated from outside the cap when said fork is inserted into said cap.

7. A cap as claimed in claim 1 comprising at least one internal abutment diametrically opposite said orifice, said abutment constituting a fulcrum for the end of the part of the actuating member which extends into the cap.

8. Cap as claimed in claim 1 which is attached to the container by means of an annular ridge at the lower part of the lateral wall of the cap which snaps into a groove provided on the lateral surface of the pressurized container.

9. Cap as claimed in claim 1 in which the movable means is attached to the lateral wall of the cap, defines a duct opening to the outside of the cap, and comprises an elastically deformable zone which deforms in response to the action of the actuating member, said cap being made of two parts assembled together.

10. Cap as claimed in claim 9 in which the two parts of the cap are a first part comprising said lateral wall, said movable means, which has two arms at right angles to each other, one arm of which is positioned in alignment with the axis of the lateral wall of the cap and the other arm of which is elastically deformable, guides attached to said wall which are parallel to the elastically deformable arm of the movable means, and an internal abutment positioned in alignment with the zone between the two guides, while the other part of the cap consists of a top therefor which is assembled to the first part.

11. Cap as claimed in claim 1 in which the movable means is a separate part which is assembled to the remainder of the cap and which opens to the outside of the cap, the remainder of the cap being made in one part.

12. Cap as claimed in claim 11 in which the movable means comprises two arms at right angles to each other, the first arm being positioned substantially along the axis of the cap and cooperating at its base with the outlet tube of the dispensing valve, the second arm being substantially radial and comprising at its end a slide plate which engages in grooves provided for this purpose inside the cap.

13. Cap as claimed in claim 11 in which the cap comprises, parallel to the radial arm of the movable dispensing means and on opposite sides thereof, two strips constituting guides for the actuating member and two strips between the foregoing strips constituting abutments for the two teeth of the fork of the actuating member.

14. Cap as claimed in claim 3 in which the movable means is a separate part comprising an internal passageway and having two arms at right angles to each other, one of which is substantially radial and terminates in a first mouth and the other of which is substantially parallel to the axis of the cap and the fork carried by the actuating member comprises at the bottom of the groove separating its two teeth a second mouth cooperating with the first mouth, said second mouth constituting one of the ends of a duct formed inside the actuating member, which duct opens at its other end to the outside of the actuating member and the outside of the cap when said actuating member is in position in the cap.

15. Cap as claimed in claim 14 in which the first and second mouths are mating male and female mouths and of conical shape.

16. Cap as claimed in claim 15 in which the first mouth is a male mouth and the second mouth is a female mouth.

17. Cap as claimed in claim 14 in which the upper part of the movable means has, perpendicularly to the axis of the passageway which fits onto the dispensing valve of the container, a section having two elongated flats which cooperate to position the movable means with respect to the external wall of the cap by means of members fixed to said external wall.

18. Cap as claimed in claim 17 in which the members fixed to the external wall of the cap are guides positioned on opposite sides of the orifice in the external wall which receives the actuating member, said guides forming therebetween a slight angle and the two elongated flats on the upper part of the movable duct forming therebetween an angle substantially equal to the angle between the guides.

* * * * *